US008056977B2

(12) United States Patent
Hinkle et al.

(10) Patent No.: US 8,056,977 B2
(45) Date of Patent: Nov. 15, 2011

(54) MOUNTING BRACKET AND CLAMP CONTACT FOR DOORWAY JUMPER APPARATUS

(76) Inventors: David R. Hinkle, Phoenix, AZ (US); Leane Vandeman, Los Angeles, CA (US)

( * ) Notice: Subject to any disclaimer, the term of this patent is extended or adjusted under 35 U.S.C. 154(b) by 650 days.

(21) Appl. No.: 11/970,342

(22) Filed: Jan. 7, 2008

(65) Prior Publication Data

US 2008/0169390 A1 Jul. 17, 2008

Related U.S. Application Data

(60) Provisional application No. 60/884,597, filed on Jan. 11, 2007.

(51) Int. Cl.
*A63G 9/12* (2006.01)
*A47F 5/00* (2006.01)

(52) U.S. Cl. ..... 297/274; 248/205.1

(58) Field of Classification Search ..... 297/273, 297/274; 248/489, 201, 202.1, 342, 207, 248/205.1, 311.3, 275, 276, 277, 281, 343, 248/344; 403/326; D8/373; 292/251; 472/118; 411/542

See application file for complete search history.

(56) References Cited

U.S. PATENT DOCUMENTS

| | | | | | |
|---|---|---|---|---|---|
| 719,013 | A | * | 1/1903 | Kerr | 248/343 |
| 1,352,317 | A | * | 9/1920 | Schwarz | 472/121 |
| 1,476,038 | A | * | 12/1923 | Birch | 248/340 |
| 2,550,530 | A | * | 4/1951 | Cartwright | 248/343 |
| 4,093,285 | A | * | 6/1978 | Fayle | 292/251 |
| 5,154,672 | A | * | 10/1992 | Brown | 472/118 |
| 5,693,909 | A | * | 12/1997 | McEwen | 174/58 |
| 7,186,183 | B2 | * | 3/2007 | Zeilinger et al. | 472/118 |
| 7,208,679 | B2 | * | 4/2007 | Phillips | 174/58 |

FOREIGN PATENT DOCUMENTS

GB 2101290 A * 1/1983

* cited by examiner

*Primary Examiner* — Milton Nelson, Jr.
(74) *Attorney, Agent, or Firm* — Christie, Parker & Hale, LLP

(57) ABSTRACT

A mounting bracket for securing a doorway jumper apparatus having clamp contacts is provided. The mounting bracket includes a flange and a housing having a receptacle area. The housing is located at a center portion of the flange. The flange includes holes through which fasteners are insertable to affix the housing to a beam or to a wall above a doorway.

15 Claims, 15 Drawing Sheets

MOUNTING BRACKET AND CLAMP CONTACT FOR DOORWAY JUMPER APPARATUS

CROSS-REFERENCE TO RELATED APPLICATION

The present application claims the benefit of U.S. provisional patent application 60/884,597 filed Jan. 11, 2007, the contents of which are hereby incorporated by reference.

BACKGROUND OF THE INVENTION

1. Field of the Invention

The present invention relates generally to a doorway jumper apparatus, and more particularly to a mounting bracket for a doorway jumper apparatus used by babies, infants, toddlers, and small children.

2. Description of Related Art

Baby swings, bouncers, jumpers, and the like, that hang in a doorway or from the ceiling are well known in the prior art. Examples include the The First Years®—Pooh Bouncing Tigger Seat, Johnny Jump-up™ Baby Exerciser, Graco Bumper Jumper®, Twist 'n Shout™, and the suspended motor-skill training apparatus disclosed in U.S. Pat. No. 6,093,024. The First Years® is a registered trademark of The First Years, Inc. Johnny Jump-up™ is a trademark of Evanflo Company, Inc. Bumper Jumper® is a registered trademark of Graco Children's Products, Inc. Twist 'n Shout™ is a trademark of Graco Children's Products, Inc.

FIG. 1 shows a doorway jumper 10 as known in the prior art. The doorway jumper 10 includes a seat 17 and straps 16 attached between seat 17 and spring housing assembly 15. The spring housing assembly 15 includes an internal spring attached to strap 14. Strap 14 is attached to clamp 12. Clamp 12 includes spring 13 so that clamp contacts 11 press against the wall to which the clamp 12 is attached.

FIG. 2 shows a front view of a door opening 20. The wall 21 may be made of drywall, plaster, wood paneling, or the like. The molding 22 is placed around the door opening 20 to cover gaps between the door opening 20 and the wall 21. The doorway jumper 10 hangs from the top of the door opening 20 with the clamp 12 typically attached to the wall 21 in the wall area 23 above the molding 22. A baby, infant, toddler, or a small child, herein termed "infant," may be placed into the seat 17 of the doorway jumper 10, thereby allowing the infant to be held aloft in the door opening 20. The straps 14, 16 of the doorway jumper 10 are adjusted such that the infant may be held aloft in the door area 20 such that the infant may make contact with the floor with his/her feet. The infant may then jump up and down or swing in the door opening 20.

As the infant moves in the door opening 20, the clamp contacts 11 may slide up, down, or sideways, or otherwise move around in the wall area 23. As the clamp contacts 11 move around in the wall area 23, portions of the wall 21 in the wall area 23 may be damaged. The clamp contacts 11 may strip off paint or dent or scratch the wall 21 in the wall area 23. In addition, if the clamp contacts move enough towards an edge of the vertical door jambs, an infant in the doorway jumper 10 may strike an edge of the vertical door jambs with a part of his/her body, thus possibly injuring the infant. Furthermore, if the infant makes sufficient jarring motions, the clamp 12 of the doorway jumper 10 may itself twist such that the clamp 12 detaches from the wall 21 in the wall area 23, thereby causing the infant to fall to the floor and possibly resulting in the infant being struck by the clamp 12 of the doorway jumper 10.

The Graco Bumper Jumper®, Twist 'n Shout™ product provides a clampless jumper apparatus for non-doorway areas by installing to the ceiling through a ceiling-mounted eye bolt. The Graco jumper apparatus provides strong support, however installing the jumper apparatus is difficult for the homeowner, and detaching the jumper apparatus from or attaching the jumper apparatus to the eye-bolt is difficult because it is at ceiling height.

Therefore a need exists for preventing the doorway jumper 10 from detaching from the wall 21 and for protecting the wall 21 in the wall area 23 from being damaged by the clamp contacts 11. In addition, a need exists for allowing the clamp-type doorway jumper 10 to be used in non-doorway areas, such as passageways in which there are exposed or wrapped beams. Furthermore, a need exists for a doorway jumper 10 that is easy to install and easy to attach or detach.

SUMMARY OF THE INVENTION

A mounting bracket for securing a doorway jumper apparatus having clamp contacts is provided. The mounting bracket includes a flange and a housing having a receptacle area. The housing is located at a center portion of the flange. The flange has holes through which fasteners are insertable to affix the housing to a wall above a doorway or to a beam.

In another embodiment, the flange includes side portions protruding laterally from the housing and the holes are located in the side portions.

In another embodiment, the flange and the housing are formed of metal and are welded together.

In another embodiment, the receptacle area conforms substantially to a shape of the clamp contacts, and walls of the housing form an entry path into the receptacle area having an area larger than a front surface area of the clamp contacts.

In another embodiment, screws are insertable into the holes for affixing the mounting bracket to a wall above a doorway or to a beam. The screws are attachable to a header located behind the wall above a doorway or to a beam. Screw caps are locatable between the screws and the holes for covering the screws when the screws are inserted into the holes and attached to the header or to the beam.

In another embodiment, a magnet is formed on the flange within the receptacle area. The magnet further secures clamp contacts formed of metal or clamp contacts having magnetic components.

In another embodiment, the flange prevents the clamp contacts from causing damage to an area of a wall in which the doorway jumper apparatus is attached and the housing secures the doorway jumper apparatus to the area of the wall in which the doorway jumper apparatus is attached.

A method for securing a doorway jumper apparatus having clamp contacts to a wall above a doorway or to a beam is provided. The method includes providing a pair of mounting brackets, each mounting bracket having a flange and a housing with a receptacle area, the housing being located at a center portion of the flange, the flange having holes through which fasteners are insertable to affix the housing to a wall above a doorway or to a beam; affixing the pair of mounting brackets to both sides of a horizontal beam by affixing fasteners to the horizontal beam, or to a wall above an entrance side and an exit side of a doorway by affixing fasteners to both sides of a header located above the doorway; and inserting the clamp contacts into the receptacle area of the respective mounting bracket.

Furthermore, in accordance with the present invention, a doorway jumper apparatus is provided. The doorway jumper apparatus includes a seat for allowing an infant to be placed therein, first straps connecting the seat to a spring housing assembly, the spring housing assembly having an internal spring attached to a second strap, the second strap also being attached to a clamp, the clamp having clamp contacts and a spring for allowing the clamp contacts to attach to a wall or to a beam; and a pair of mounting brackets, each mounting bracket having a flange and a housing, the housing having a receptacle area for receiving the clamp contacts, the housing being located at a center portion of the flange, wherein the flange includes holes through which fasteners are insertable to affix the housing to a beam or to a wall above a doorway.

In another embodiment, a magnet is located within the clamp contacts for allowing the clamp contacts to attach more securely to the mounting bracket.

DETAILED DESCRIPTION

Figure 1:
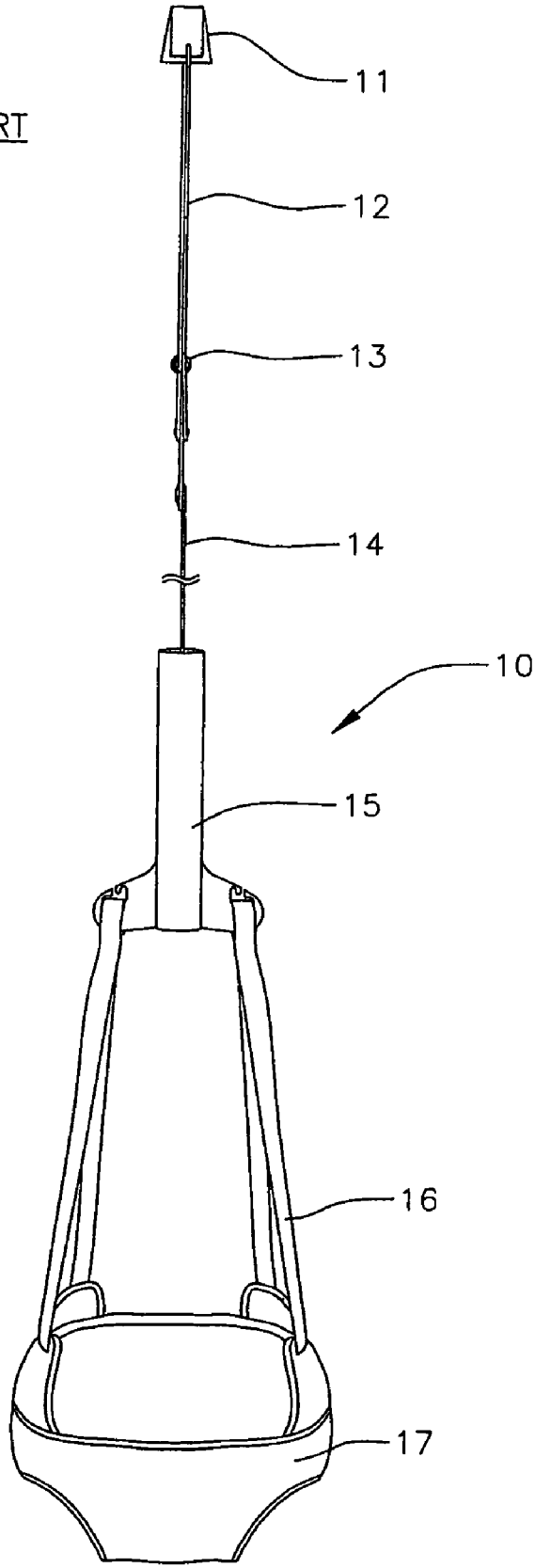
FIG. 1 PRIOR ART
FIG. 1 is a perspective view of a conventional doorway jumper apparatus.

The present invention provides a mounting bracket that prevents the doorway jumper 10 from detaching from the wall 21, protects the wall 21 in the wall area 23 from being damaged by the clamp contacts 11, and allows the doorway jumper 10 to be installed in non-doorway areas in which there are exposed or wrapped beams. Furthermore, according to the present invention, an improved clamp apparatus is provided that provides further security so that the clamp 12 remains attached to the wall 21.

Figure 3:
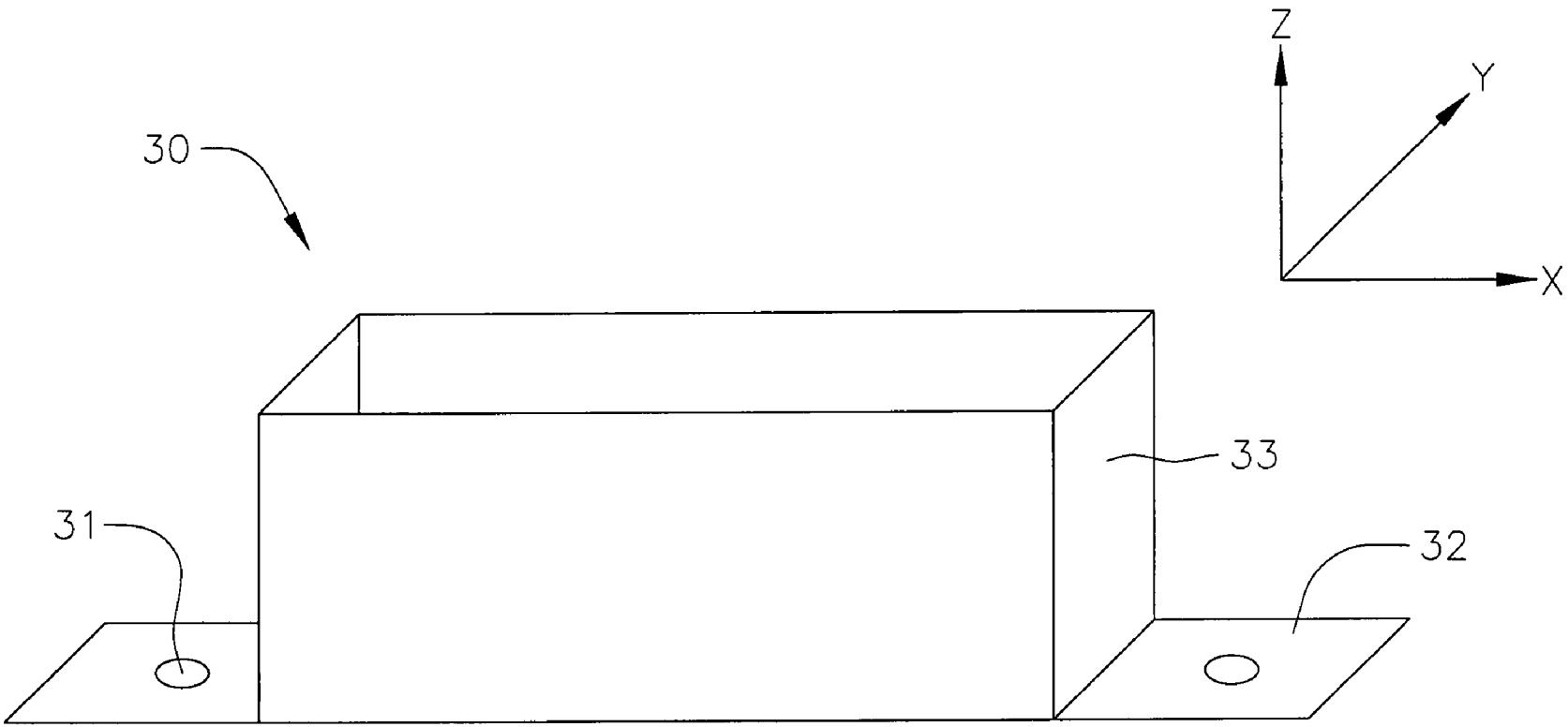
FIG. 3 is a perspective view of a mounting bracket according to an embodiment of the present invention.

FIG. 3 shows a mounting bracket 30 according to an embodiment of the present invention. The mounting bracket 30 is formed of a flange 32 and a housing 33. The flange 32 is a thin strip of metal that extends in a plane horizontally in the x direction and vertically in the y direction. The flange 32 has a length that extends in the x direction (horizontal direction) that is greater than a width that extends in the y direction (vertical direction). The flange includes holes 31 located horizontally from each other in the x direction on each end of the flange 32. The housing 33 is also made of metal and is welded onto the flange 32 so as to form a receptacle area that extends out in the z direction from the flange 32 with various shapes that may correspond to the clamp contacts 11 of the doorway jumper 10. The mounting bracket 30 may alternatively be made of wood, plastic, or some like material, however a mounting bracket 30 formed of metal, such as steel or aluminum, would provide the best functionality, as metal would not break or crack like wood or plastic.

The mounting bracket 30 is attached to the wall through a header beam typically located above the molding 22 in the wall area 23 on the entrance and exit sides of the door opening 20 using screws inserted through holes 31 and screwed into the header. Alternatively, the mounting bracket 30 may be attached to the header using nails inserted through holes 31 and nailed into the header.

The mounting bracket 30 is attached to the front and back side of the door opening 20 so that clamp contacts 11 of the doorway jumper 10 may each be inserted into the housing 33 of the respective mounting bracket 30. As the infant moves in the seat 17 of the doorway jumper 10, the clamp contacts 11 will be confined to movement within the housing 33 of each of the mounting brackets 30. Therefore, as the clamp contacts 11 shift in the wall area 23 of the wall 21, only the top surface of the flange 32 located inside the housing 33 will wear from contact with the clamp contacts 11.

According to another embodiment of the present invention, the housing 33 of the mounting bracket 30 may be formed to have a similar shape to the clamp contacts 11. That is, the walls of the housing 33 may form an entry path into the housing 33 with the area of the entry path having a slightly larger area than the front surface area of the clamp contacts 11. Forming the housing 33 with a similar shape to the clamp contacts 11 prevents the clamp contacts 11 from shifting or moving significantly within the mounting bracket 30, thereby preventing the clamp 12 from twisting and detaching from the wall 21 and from moving close enough to a vertical door jamb such that an infant could possibly strike an edge of the vertical door jambs with his/her body, thus causing injury to the infant.

As mentioned above, the clamp contacts 11 have a shape such that movement within the mounting bracket 30 is limited. In an exemplary embodiment, the clamp contacts 11 are prevented from shifting or moving significantly within the mounting bracket 30 such that the clamp contacts 11 do not move upward, downward, or sideways greater than distance equal to a diameter or a length or a width of the clamp contact 11. In another exemplary embodiment, the movement of the clamp contacts 11 within the mounting bracket 30 is limited to about one inch within the mounting bracket. Limiting movement of the clamp contacts 11 within the mounting bracket 30 helps prevent the clamp contacts 11 from dislodging/disconnecting from the wall 21, and furthermore, prevents the clamp contacts 11 from moving close enough to the vertical door jambs such that an infant could possible strike an edge of the vertical door jambs with his/her body.

Figure 4:
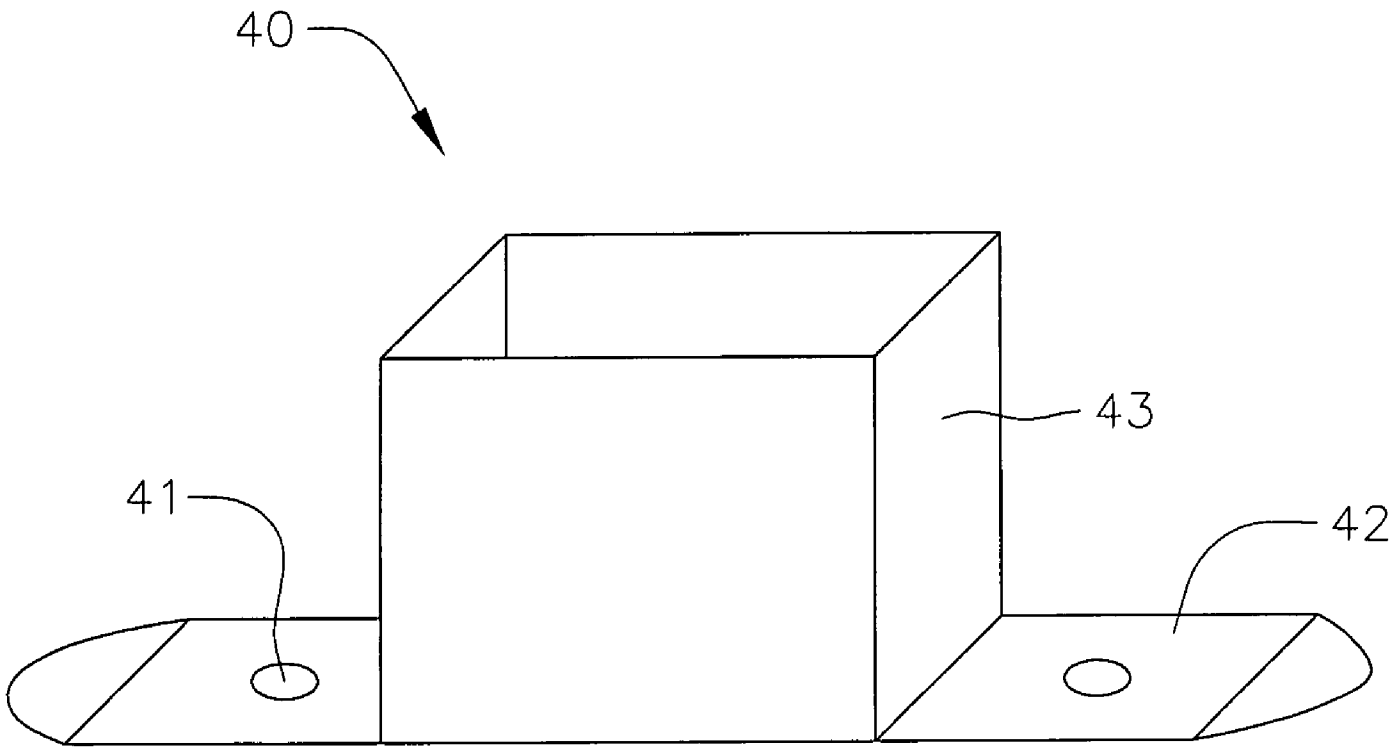
FIG. 4 is a perspective view of a mounting bracket according to another embodiment of the present invention.

FIG. 4 shows a mounting bracket 40 according to another embodiment of the present invention. As shown in FIG. 4, the flange 42 may have rounded edges rather than cornered edges on the ends of the flange 42 corresponding to the location of the holes 41, and the housing 43 may be formed to have a different shape in order to limit movement of or conform to the clamp contacts 11 of the doorway jumper 10.

Figure 5:
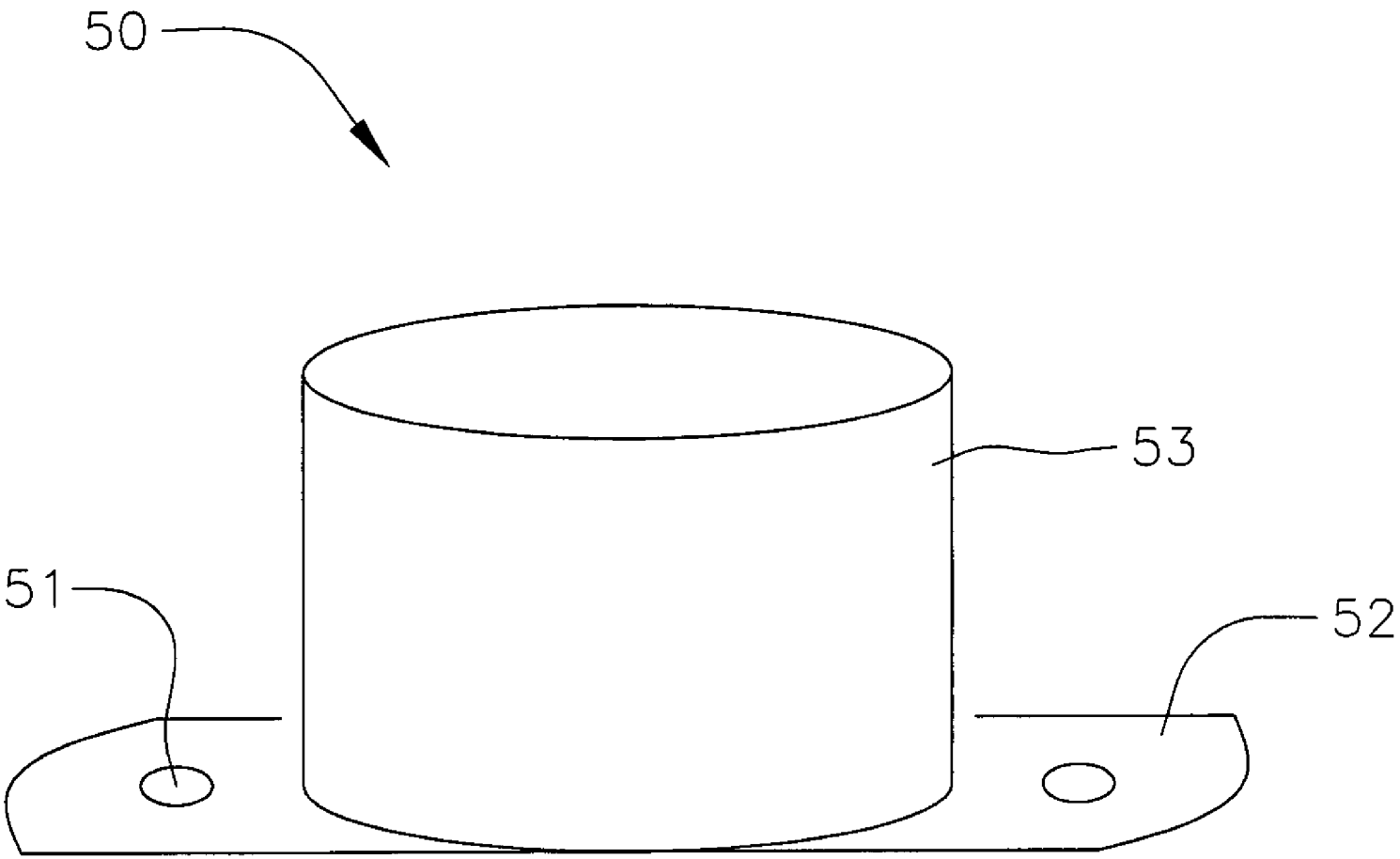
FIG. 5 is a perspective view of a mounting bracket according to another embodiment of the present invention.

FIG. 5 shows a mounting bracket 50 according to another embodiment of the present invention. As shown in FIG. 5, the housing 53 may be formed to have a round shape so as to conform to a clamp contact 11 also having a round shape. The flange 52 and holes 51 are the same as that shown in FIG. 4. Previous figures have shown the housing with a single type of shape, whether rectangular or circular in shape, but the housing can take on any shape, including a composition of multiple shapes in order to allow different shaped clamp contacts 11 to fit within the housing.

Figure 6:
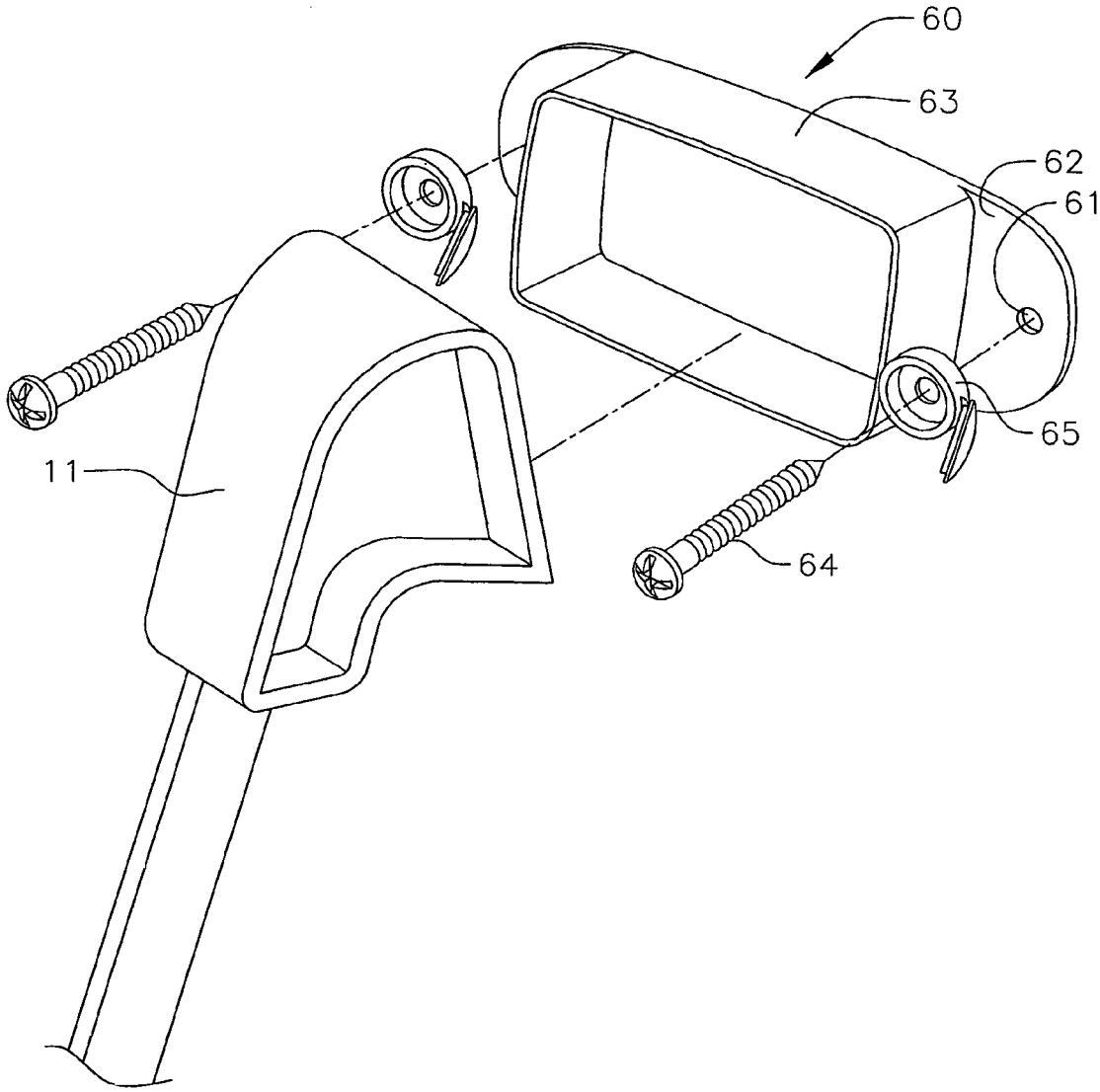
FIG. 6 is a perspective exploded view of a mounting bracket and clamp contacts according to another embodiment of the present invention.

FIG. 6 is a perspective exploded view of a mounting bracket 60 and clamp contacts 11 according to another embodiment of the present invention. The mounting bracket 60 includes a flange 62, a housing 63 in which clamp contacts 11 are inserted, and holes 61 located in side portions of the flange 62. The mounting bracket 60 is secured to the header above the door opening 20 using screws 64. The screws may each be inserted into a screw cap 65 in order to make the mounting bracket 60 more aesthetically pleasing to the eye.

Figure 7:
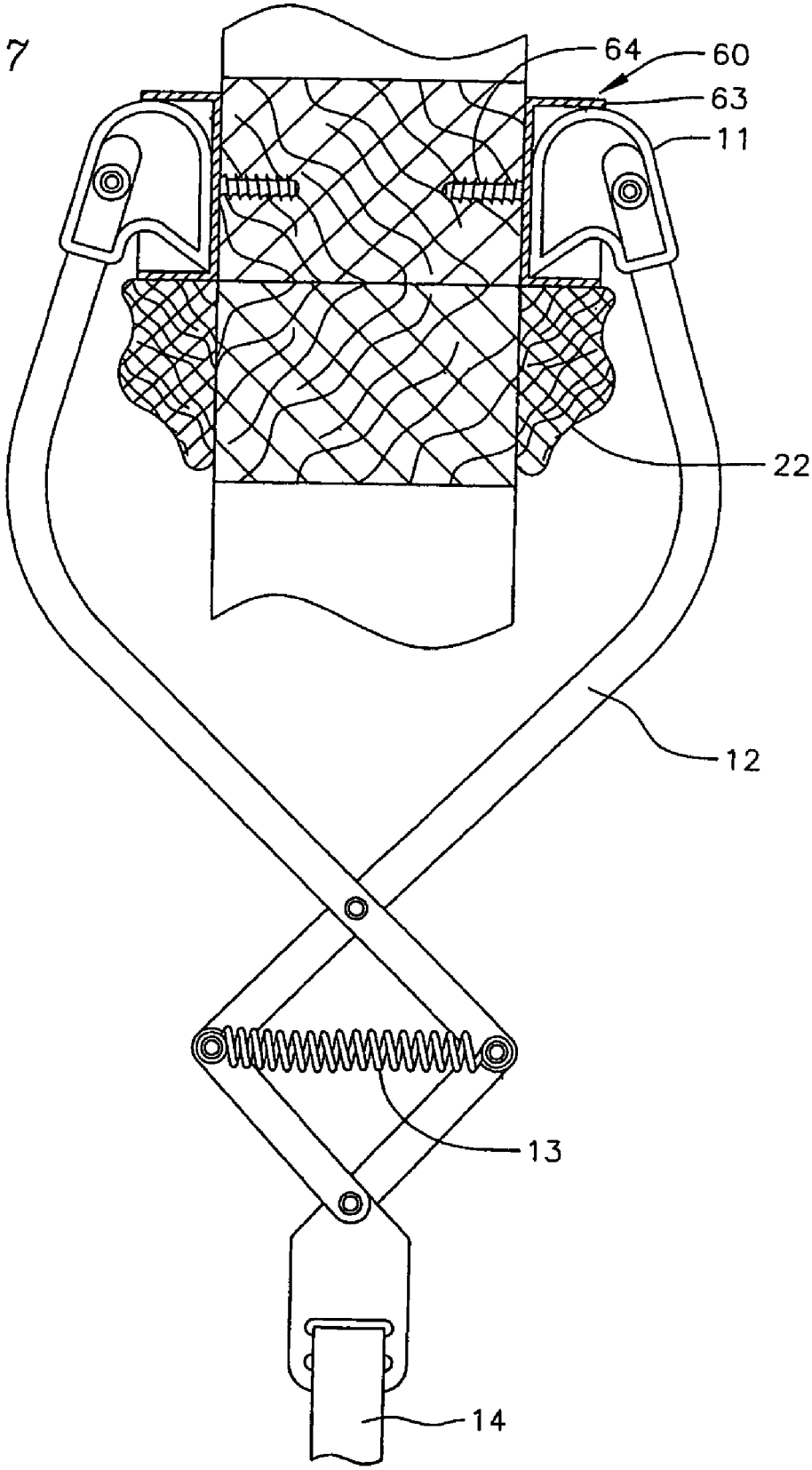
FIG. 7 is a side view of a mounting bracket with inserted clamp contacts according to another embodiment of the present invention.

FIG. 7 shows a side view of a mounting bracket 60 with inserted clamp contacts 11 according to another embodiment of the present invention. Mounting brackets 60 are affixed to the wall above the molding 22 using screws 64 screwed through the wall and into the header located above the door opening. Clamp contacts 11 fit within the receptacle area of the housing 63.

Figure 8:
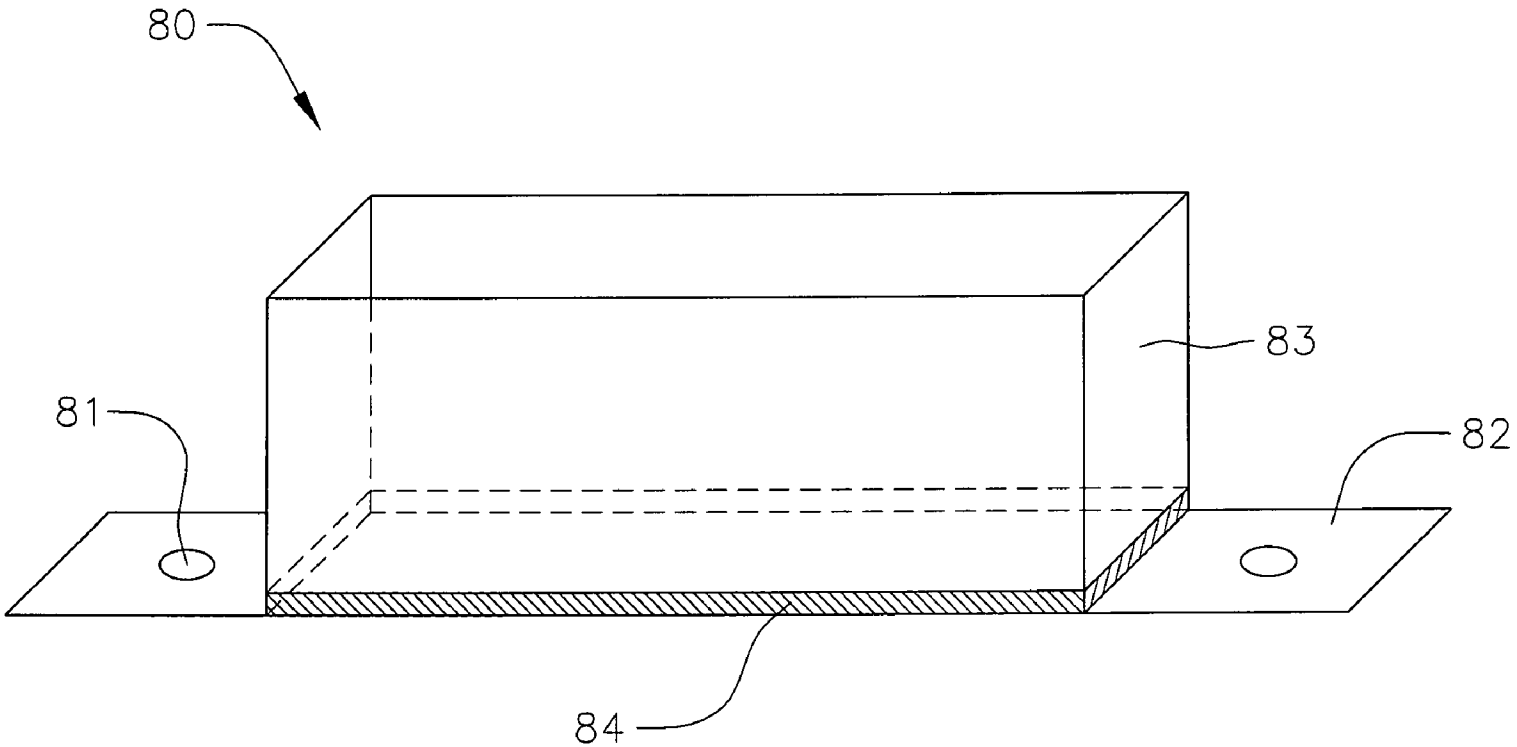
FIG. 8 is a perspective view of a mounting bracket according to another embodiment of the present invention.

FIG. 8 shows a mounting bracket 80 according to another embodiment of the present invention. The mounting bracket 80 includes flange 82 with holes 81, housing 83, and a magnet 84 formed on the flange 82 inside the housing 83. The magnet 84 provides a stronger attachment for clamp contacts 11 made of metal or with magnetic components.

Figure 9:
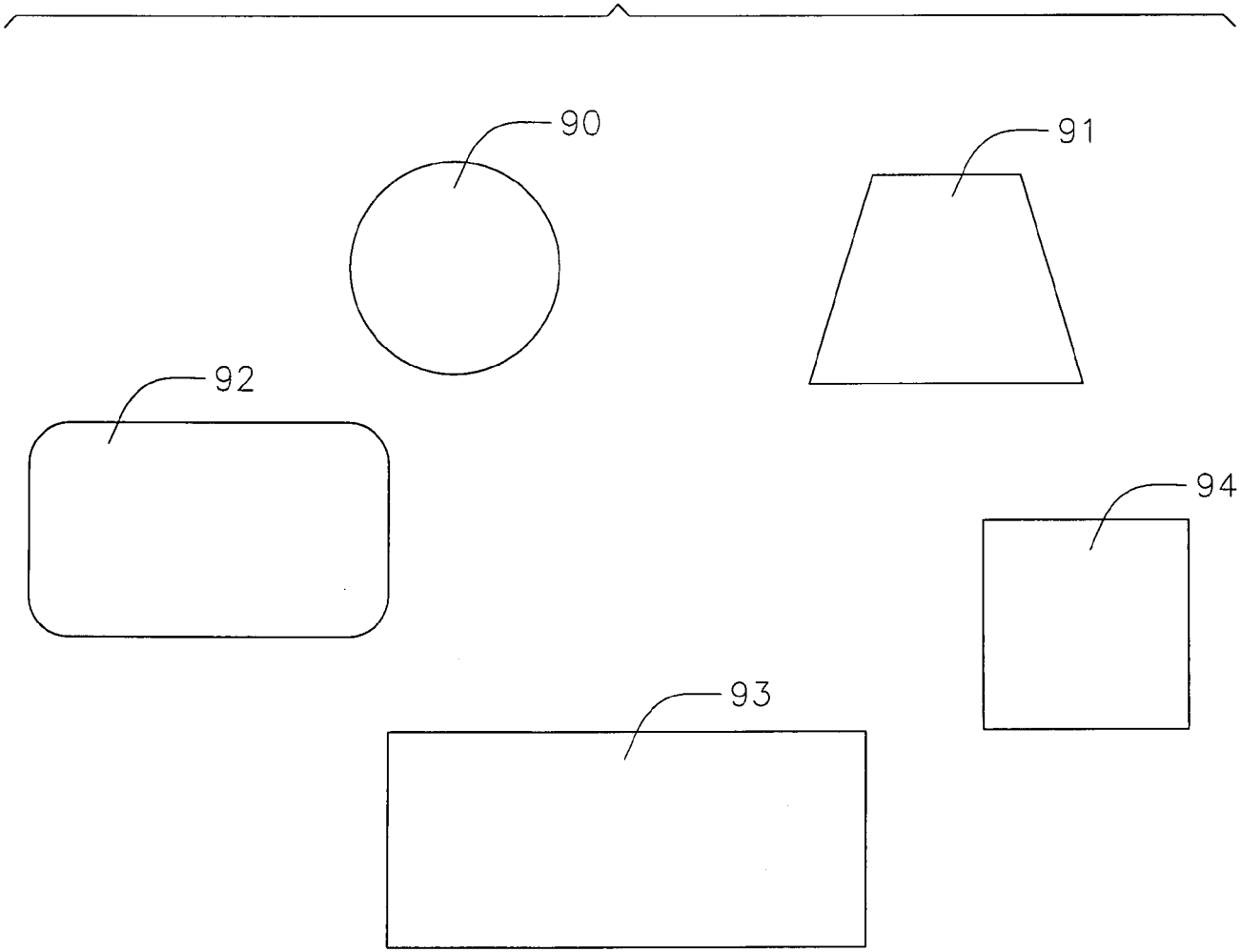
FIG. 9 PRIOR ART
FIG. 9 is a front view of conventional clamp contacts as shown in FIG. 1.

FIG. 9 shows a front view of several different clamp contacts 90, 91, 92, 93, 94 known in the prior art. Clamp contacts may be circular, trapezoidal, rectangular, rectangular with rounded edges, square, or any other conceivable shape. The mounting bracket according to embodiments of the present invention may be formed such that the mounting bracket substantially conforms to one or more of these shapes so that the clamp contacts 11 may fit securely within the housing of the mounting bracket.

Figure 10:
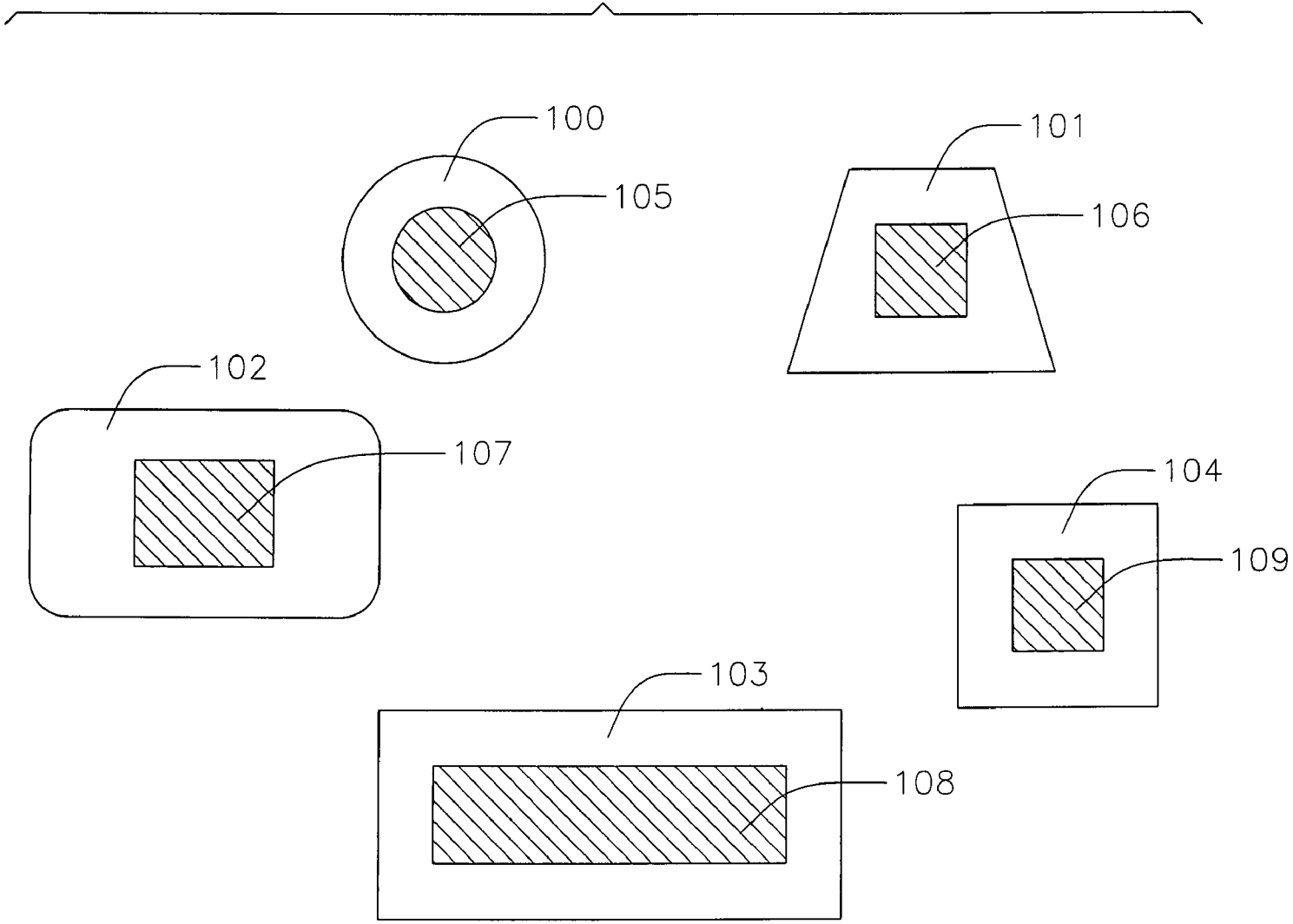
FIG. 10 is a front view of clamp contacts according to an embodiment of the present invention.

FIG. 10 shows clamp contacts 100, 101, 102, 103, 104 according to embodiments of the present invention. The clamp contacts 100, 101, 102, 103, 104 may be formed with a magnetic center 105, 106, 107, 108, 109, respectively, so as to provide a stronger attachment to the various embodiments of the mounting bracket, and provide an especially strong attachment to the mounting bracket 80 with a magnet 84.

Figure 11:
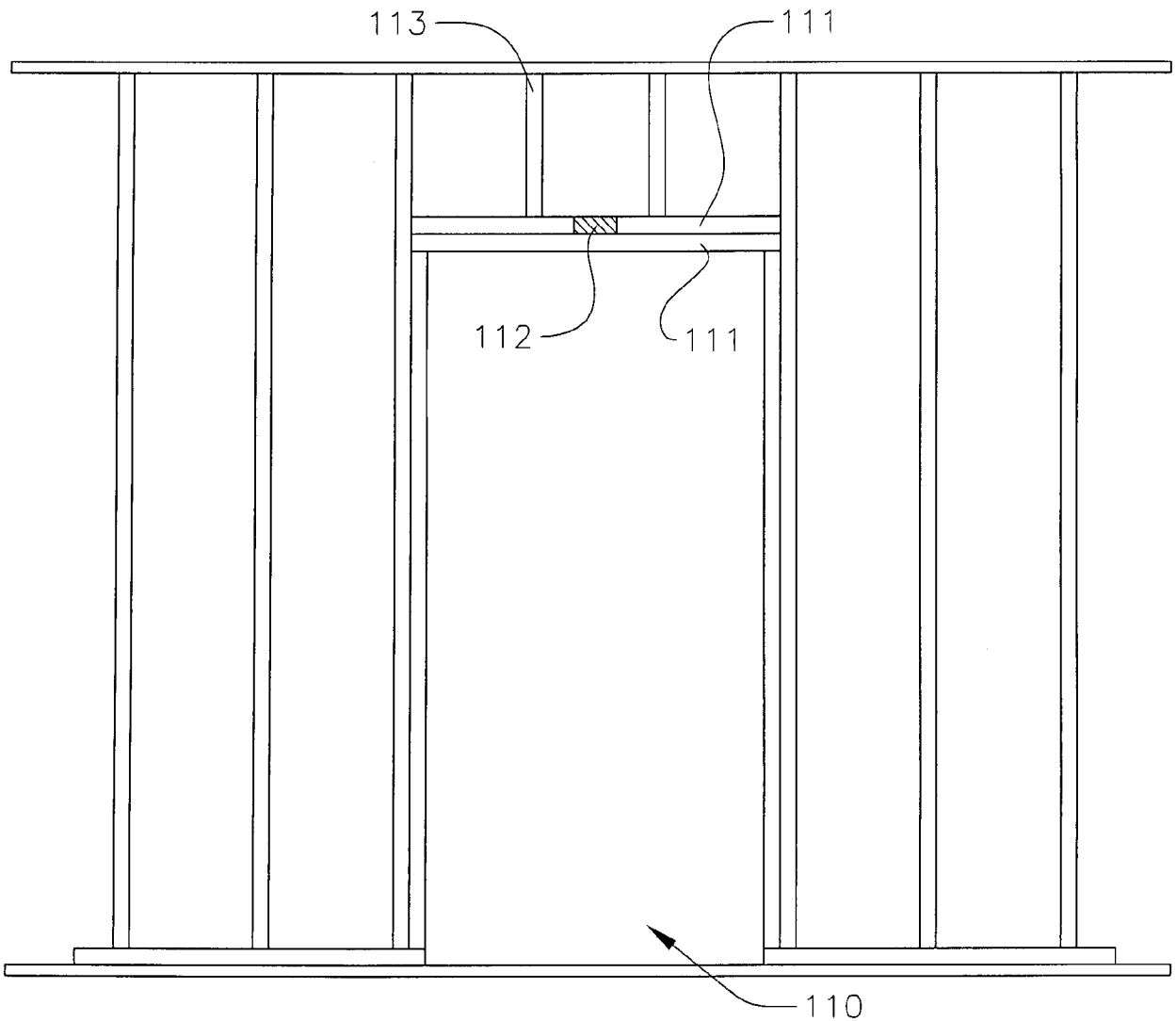
FIG. 11 is a front view of an interior door opening stud layout showing a placement of the mounting bracket with respect to the stud layout.

FIG. 11 shows an interior door opening stud layout and a placement of the mounting bracket 112 with respect to the stud layout. The mounting bracket 112 is attached to the wall 21, which may be plaster, drywall, wood paneling, or the like, at a location corresponding to the header 111 located above the door opening 110. The header 111 is located horizontally below the cripple studs 113. The header 111 is formed of dimensional lumber, typically two 2×4s as shown in FIG. 11, or two 2×6s or two 2×8s placed on edge, or one 4×4. The actual size of the header is not important. No matter the size of the header, the mounting bracket 112 may be attached to the header with screws inserted through the horizontally located holes for attaching the mounting bracket to the wall.

Figure 2:
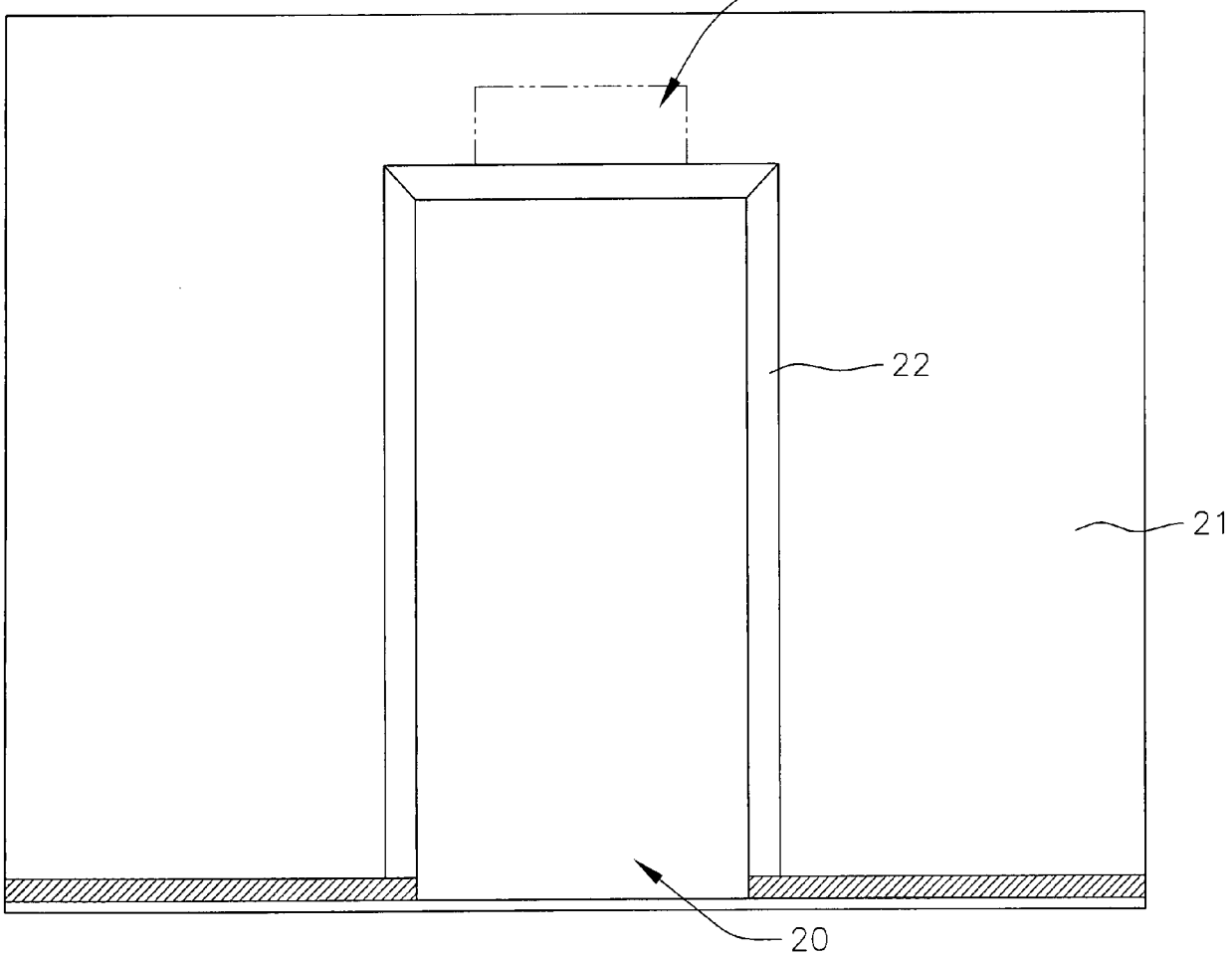
FIG. 2 PRIOR ART
FIG. 2 is a front view of a door opening.

In relation to FIG. 2, the header 111 is located just above the upper molding 22 of the door opening 20, as the wall 21 extends below the header 111. Therefore, the mounting bracket 112 can always be attached to the header 111 in the wall area 23 of the wall 21.

Figure 12:
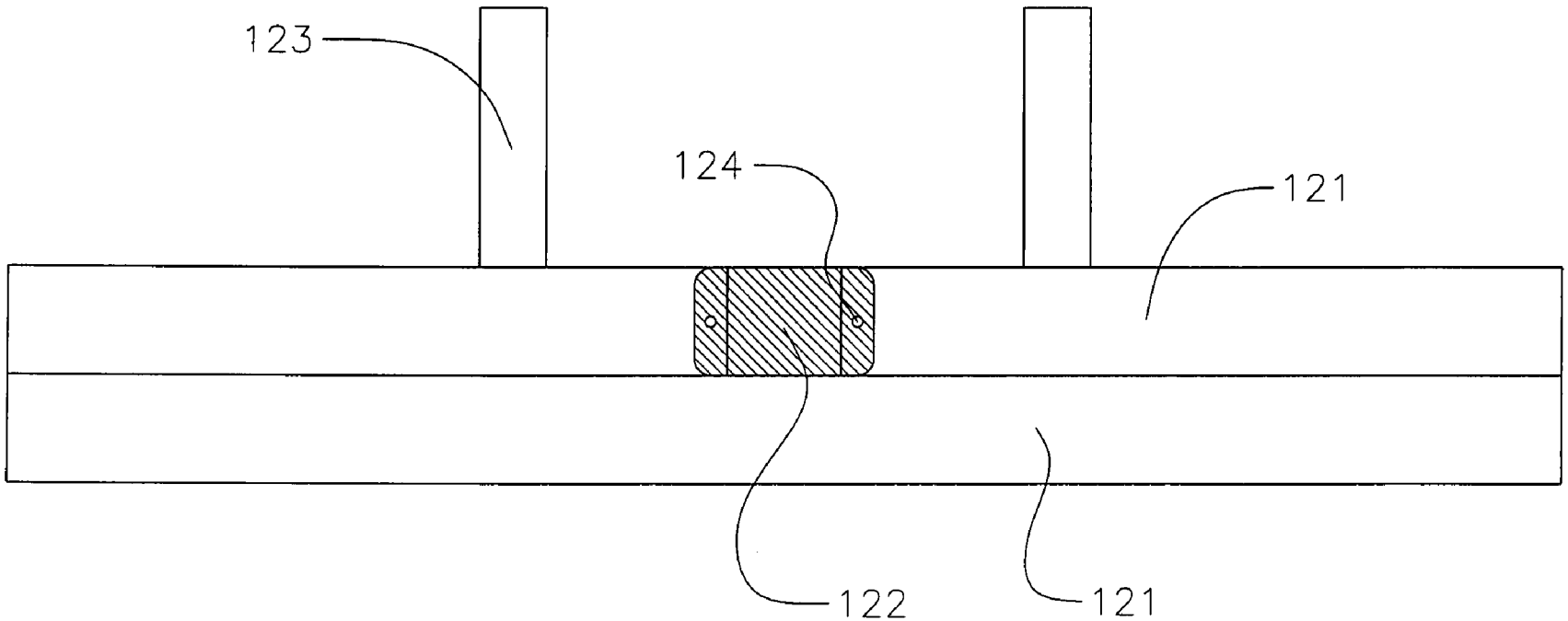
FIG. 12 is a close-up front view of an interior door opening stud layout showing the placement of the mounting bracket with respect to the stud layout.

FIG. 12 shows a close-up of the interior door opening stud layout and the placement of the mounting bracket 122 with respect to the stud layout. The header 121 is horizontally located above the door opening just below the cripple studs 123. Consumers who install the mounting bracket 122 may use a stud finder or knock on the wall to determine the location of the header 121. The mounting bracket 122 is firmly attached to the wall with screws inserted through the screw holes 124 of the mounting bracket 122. The mounting bracket 122 is aligned with the header 121 so that the mounting bracket screw holes 124 extend horizontally along the header 121.

As disclosed above, the mounting bracket of the present invention includes a flange that extends vertically in the y direction and to a larger extent horizontally in the x direction, and has screw holes located on each end in the x direction, and a housing that extends out in the z direction so as to keep the clamp confined to the mounting bracket. The flange protects the wall area 23 of the wall 21 from being damaged by movement of the clamp contacts 11. The housing prevents the clamp contacts 11 from moving beyond the confining space of the mounting bracket. A magnet may be located on the flange within the space of the housing. The magnet provides a stronger attachment to clamp contacts 11 made of metal, and an even stronger attachment to clamp contacts 11 containing a magnet aligned so as to be attracted to the magnet located on the flange.

Figure 13:
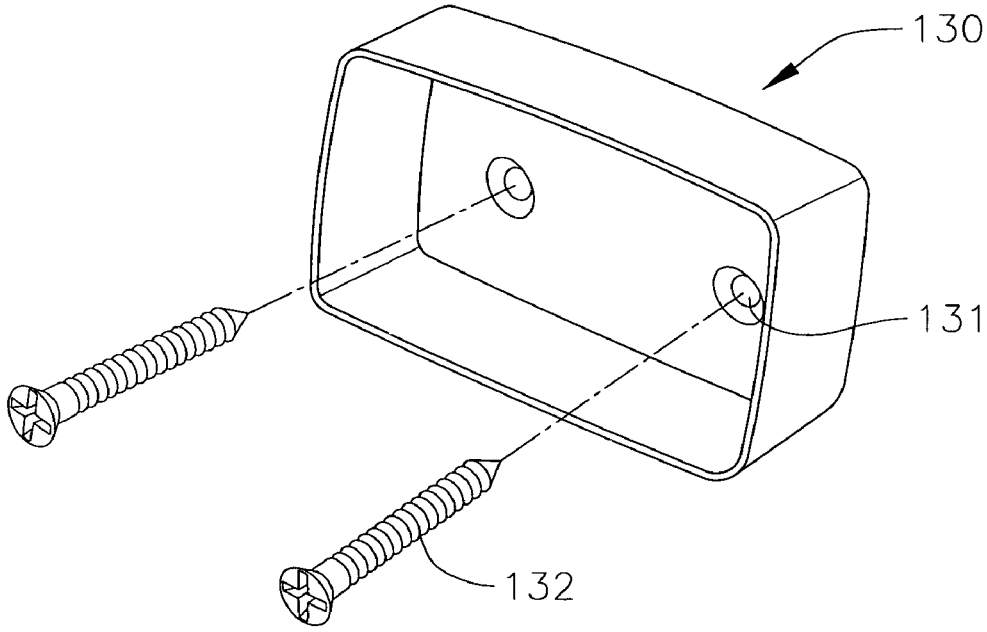
FIG. 13 is a perspective exploded view of a mounting bracket according to another embodiment of the present invention.

FIG. 13 is a perspective exploded view of a mounting bracket 130 according to another embodiment of the present invention. Previous embodiments have shown the holes in the mounting bracket in side portions of the flange extending out from the receptacle area of the housing. Alternatively, the holes 131 may be located on the flange within the receptacle area of the housing. Flat-head screws 132 may be used in this embodiment, as they would install flush to the flange, thus allowing the clamp contacts 11 to be flush with the flange within the receptacle area of the housing.

Figure 14:
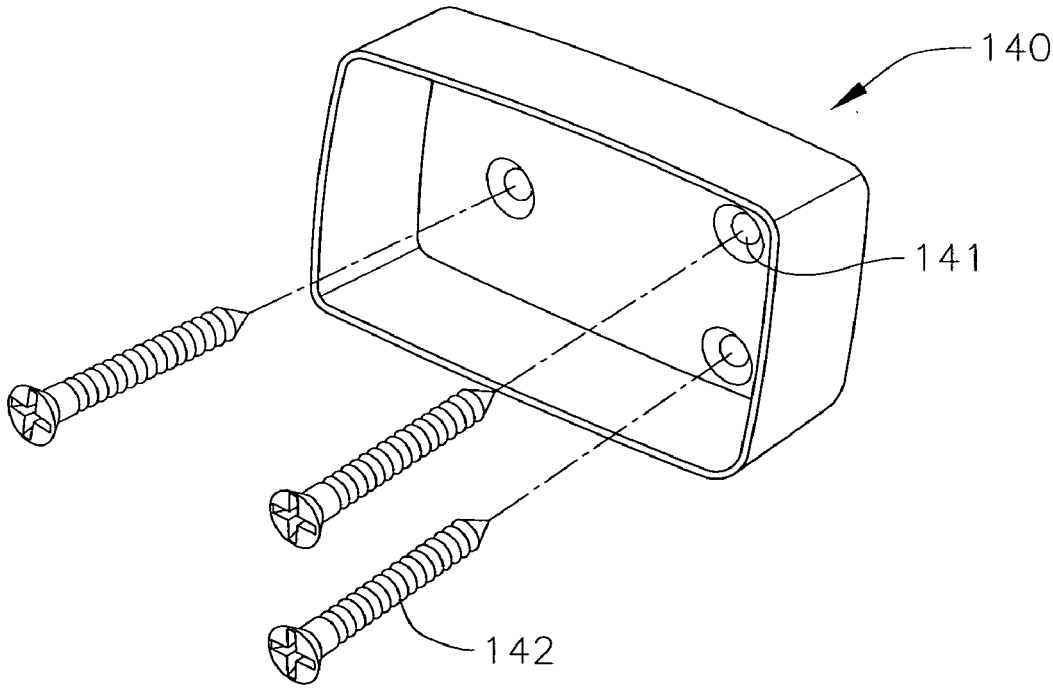
FIG. 14 is a perspective exploded view of a mounting bracket according to another embodiment of the present invention.

FIG. 14 is a perspective exploded view of a mounting bracket 140 according to another embodiment of the present invention. Previous embodiments have shown two holes in the flange in a horizontal direction, but the holes 141 may be located in various locations in the flange in order to allow the mounting bracket to be affixed securely to the wall. Flat-head screws 142 are used so that they remain flush to the flange within the receptacle area of the housing.

Figure 15:
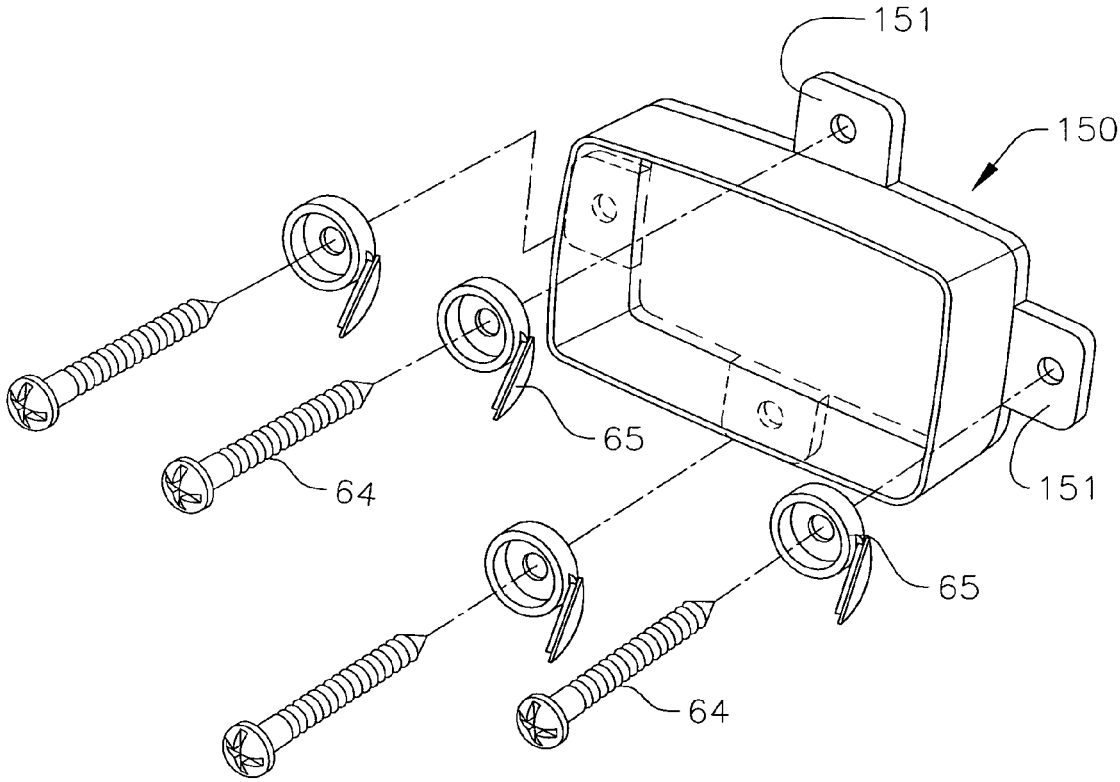
FIG. 15 is a perspective exploded view of a mounting bracket according to another embodiment of the present invention.

FIG. 15 is a perspective exploded view of a mounting bracket 150 according to another embodiment of the present invention. The side portions of the flange 151 may extend vertically as well as horizontally, therefore being located on all sides of the receptacle area of the housing. Screws 64 and screw caps 65 may be used as described in previous embodiments.

Figure 16:
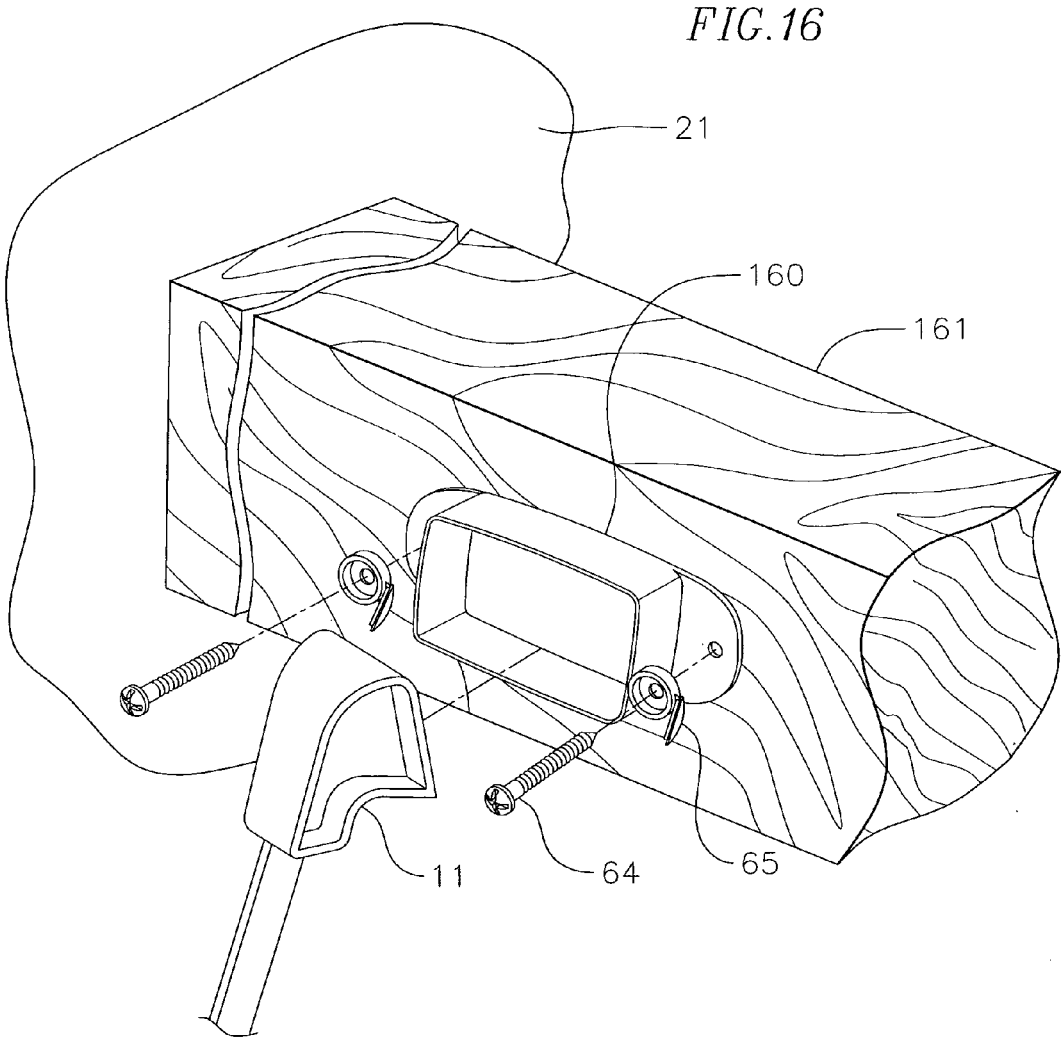
FIG. 16 is a perspective exploded view of a mounting bracket being mounted to any exposed or wrapped beam according to another embodiment of the present invention.

FIG. 16 is a perspective exploded view of a mounting bracket 160 being mounted to any exposed or wrapped beam 161 according to another embodiment of the present invention. The doorway jumper 10 as described in the prior art is made to be installed in doorways, as the trim 22 prevents the clamp of the doorway jumper 10 from sliding off the wall 21. The mounting bracket 160 allows the doorway jumper 10 to be installed anywhere with or without molding where there is a horizontal beam, header, or studs, such as for example, an archway, or exposed beams or beams wrapped in drywall, plaster, wood paneling, or the like. As shown in FIG. 16, the mounting bracket 160 may be mounted or affixed to the beam 161. A mounting bracket 160 is attached to each side of the beam 161. Screws 64 may be used to affix the mounting brackets to the beam 161. Screw caps 65 may be used to hide the screws 64 from being viewed. The clamp contacts 11 may then be inserted into the respective receptacle areas of the mounting brackets 160.

As can be appreciated from the prior description, the mounting bracket according to the present invention, provides several functions. First, the mounting bracket protects the wall in which the doorway jumper 10 is attached. Second, the mounting bracket secures the doorway jumper 10 in place so that it does not detach from the wall. Third, the mounting bracket allows the doorway jumper 10 to be installed in non-doorway areas, such as passageways, or otherwise locations in which there are exposed or wrapped beams. Lastly, the mounting bracket provides for ease of detaching or attaching the doorway jumper 10.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A method for securing a doorway jumper apparatus to a wall above a doorway or to a beam, the method comprising:

providing a pair of mounting brackets, each mounting bracket comprising a flange and a housing having a receptacle area, the housing being located at a center portion of the flange, the flange having holes through which fasteners are insertable to affix the housing to a wall above a doorway or to a horizontal beam;

affixing the pair of mounting brackets to both sides of the horizontal beam by affixing the fasteners to the horizontal beam, or to the wall above both sides of the doorway by affixing the fasteners to both sides of a header located above the doorway; and inserting each of a pair of clamp contacts of the doorway jumper apparatus into the receptacle area of a respective one of the pair of mounting brackets, wherein at least one wall of the housing extending in an outward direction from the flange and defining a periphery of the receptacle area surrounds and confines movement of the clamp contact in each of a first direction perpendicular to the outward direction, a second direction opposite the first direction, a third direction perpendicular to each of the outward direction and the first direction, and a fourth direction opposite the third direction.

2. The method as claimed in claim 1, wherein the flange includes side portions protruding laterally from the housing and the holes are located in the side portions.

3. The method as claimed in claim 1, further comprising:

forming the flange and the housing of metal; and welding the housing and the flange together.

4. The method as claimed in claim 1, further comprising:

conforming the receptacle area to a shape of the respective clamp contact, the at least one wall of the housing forming an entry path into the receptacle area having an area larger than a front surface area of the respective clamp contact.

5. The method as claimed in claim 1, wherein the pair of mounting brackets are affixed to the wall by inserting screws into the holes and attaching the screws to the horizontal beam or to the header located behind the wall above the doorway; and locating screw caps between the screws and the holes for covering the screws when the screws are inserted into the holes and attached to the header.

6. A mounting assembly for securing a doorway jumper apparatus, the mounting assembly comprising:

a flange having holes through which fasteners are insertable to affix the mounting assembly to a wall above a doorway or to a beam;

a housing having a receptacle area and comprising at least one wall extending in an outward direction from the flange and defining a periphery of the receptacle area, the housing being located at a center portion of the flange; and a clamp contact coupleable to the doorway jumper apparatus and inserted in the receptacle area, wherein the at least one wall surrounds and confines movement of the clamp contact in each of a first direction perpendicular to the outward direction, a second direction opposite the first direction, a third direction perpendicular to each of the outward direction and the first direction, and a fourth direction opposite the third direction.

7. The mounting assembly of claim 6, wherein the at least one wall confines movement of the clamp contact such that the clamp contact cannot move in the first, second, third, or fourth direction by a distance greater than a diameter, a length, or a width of the clamp contact.

8. The mounting assembly of claim 6, wherein the at least one wall confines movement of the clamp contact such that the clamp contact cannot move in the first, second, third, or fourth direction by a distance greater than about one inch.

9. A mounting assembly as claimed in claim 6, wherein the flange includes side portions protruding laterally from the housing and the holes are located in the side portions.

10. The mounting assembly as claimed in claim 9, wherein the flange and the housing are formed of metal and are welded together.

11. The mounting assembly as claimed in claim 10, wherein the receptacle area conforms substantially to a shape of the clamp contact, the at least one wall of the housing forming an entry path into the receptacle area having an area larger than a front surface area of the clamp contact.

12. The mounting assembly as claimed in claim 11, further comprising:

screws insertable into the holes for affixing the mounting bracket to a wall above a doorway or to a beam, the screws being attachable to a header located behind the wall above the doorway or to the beam; and screw caps locatable between the screws and the holes for covering the screws when the screws are inserted into the holes and attached to the header or to the beam.

13. A doorway jumper apparatus comprising:

a seat for allowing an infant to be placed therein, first straps connecting the seat to a spring housing assembly, the spring housing assembly having an internal spring attached to a second strap, the second strap also being attached to a clamp, the clamp having clamp contacts and a spring for allowing the clamp contacts to attach to a wall or to a beam; and a pair of mounting brackets, each mounting bracket comprising a flange and a housing, the housing comprising at least one wall extending in an outward direction from the flange and defining a periphery of a receptacle area receiving a clamp contact of the clamp contacts therein, the housing being located at a center portion of the flange, wherein the flange includes holes through which fasteners are insertable to affix the housing to the beam or to the wall above a doorway, wherein the at least one wall surrounds and confines movement of the clamp contact in each of a first direction perpendicular to the outward direction, a second direction opposite the first direction, a third direction perpendicular to each of the outward direction and the first direction, and a fourth direction opposite the third direction.

14. The doorway jumper apparatus of claim 13, wherein the at least one wall confines movement of the clamp contact such that the clamp contact cannot move in the first, second, third, or fourth direction by a distance greater than a diameter, a length, or a width of the clamp contact.

15. The doorway jumper apparatus of claim 13, wherein the at least one wall confines movement of the clamp contact such that the clamp contact cannot move in the first, second, third, or fourth direction by a distance greater than about one inch.

* * * * *